US007667411B2

(12) United States Patent
Kim et al.

(10) Patent No.: US 7,667,411 B2
(45) Date of Patent: Feb. 23, 2010

(54) BACKLIGHT ASSEMBLY HAVING VOLTAGE BOOSTING SECTION WITH ELECTRICALLY ISOLATED PRIMARY SIDE AND SECONDARY SIDE

(75) Inventors: Ju Rae Kim, Suwon (KR); Ho Young Kim, Suwon (KR); Sook Gyu Min, Suwon (KR); Jung Won Hwang, Suwon (KR); Jun Boum Lim, Suwon (KR); Jeong Won Yun, Suwon (KR)

(73) Assignee: Samsung Electro-Mechanics Co., Ltd., Suwon-Si, Gyunggi-Do (KR)

( * ) Notice: Subject to any disclaimer, the term of this patent is extended or adjusted under 35 U.S.C. 154(b) by 345 days.

(21) Appl. No.: 11/467,741

(22) Filed: Aug. 28, 2006

(65) Prior Publication Data

US 2007/0114953 A1 May 24, 2007

(30) Foreign Application Priority Data

Nov. 24, 2005 (KR) ..... 10-2005-0112708
Jul. 13, 2006 (KR) ..... 10-2006-0065722

(51) Int. Cl.
*H05B 41/16* (2006.01)

(52) U.S. Cl. ..... 315/282; 315/312; 315/291; 315/224; 315/277; 315/209 R; 363/74; 363/98; 363/101

(58) Field of Classification Search ..... 315/209 R, 315/276–279, 282, 224, 291, 312, 324; 363/74, 363/75, 97, 98, 101, 131
See application file for complete search history.

(56) References Cited

U.S. PATENT DOCUMENTS 5,880,946 A * 3/1999 Biegel ..... 363/75
6,534,934 B1 * 3/2003 Lin et al. ..... 315/312
6,919,697 B2 * 7/2005 Jang ..... 315/291

(Continued)

FOREIGN PATENT DOCUMENTS

CN 1402600 A 3/2003

(Continued)

OTHER PUBLICATIONS

English Translation of Notification of the First Office Action.

*Primary Examiner*—Haissa Philogene
(74) *Attorney, Agent, or Firm*—Lowe Hauptman Ham & Berner

(57) ABSTRACT

A backlight assembly includes a switching section for switching on/off an input voltage so as to output a primary voltage in accordance with a control signal; and a voltage boosting section for boosting the primary voltage received at a primary side thereof to a secondary voltage at a secondary side thereof. The primary and secondary sides of the voltage boosting section are electrically isolated from each other. In a feedback link for supplying the control signal from the secondary side to the primary side, a signal isolation section is provided for both transmitting the control signal between and electrically isolating primary side and secondary side portions of the feedback link. Additionally or alternatively, a balancing circuit section is connected between the secondary side of the voltage boosting section and a plurality of lamps so as to uniformly supply an alternating current, generated by the secondary voltage, to the lamps, in order to uniformize the luminances of the lamps.

23 Claims, 3 Drawing Sheets

U.S. PATENT DOCUMENTS

| | | | | |
|---|---|---|---|---|
| 7,271,549 | B2 * | 9/2007 | Wey et al. | 315/282 |
| 2004/0056607 | A1 | 3/2004 | Henry | |

FOREIGN PATENT DOCUMENTS

| | | | |
|---|---|---|---|
| JP | 07-281148 | A | 10/1995 |
| JP | 2005-020992 | A | 1/2005 |
| KR | 1020050096907 | A | 10/2005 |
| KR | 1020050097040 | A | 10/2005 |
| KR | 1020060078496 | A | 7/2006 |
| KR | 1020060092330 | A | 8/2006 |
| TW | 502487 | B | 9/2002 |

* cited by examiner

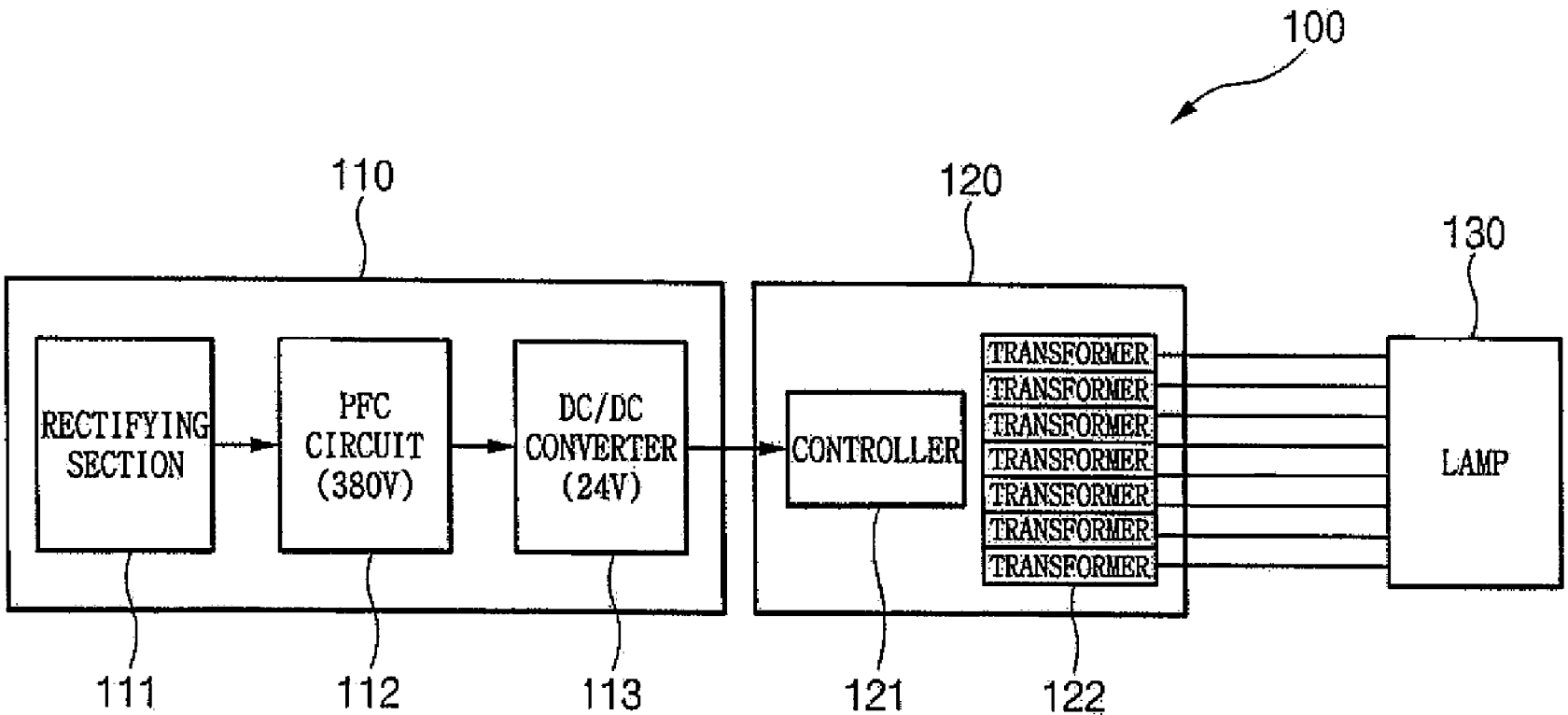
[FIG. 1]
(PRIOR ART)

[FIG. 2]
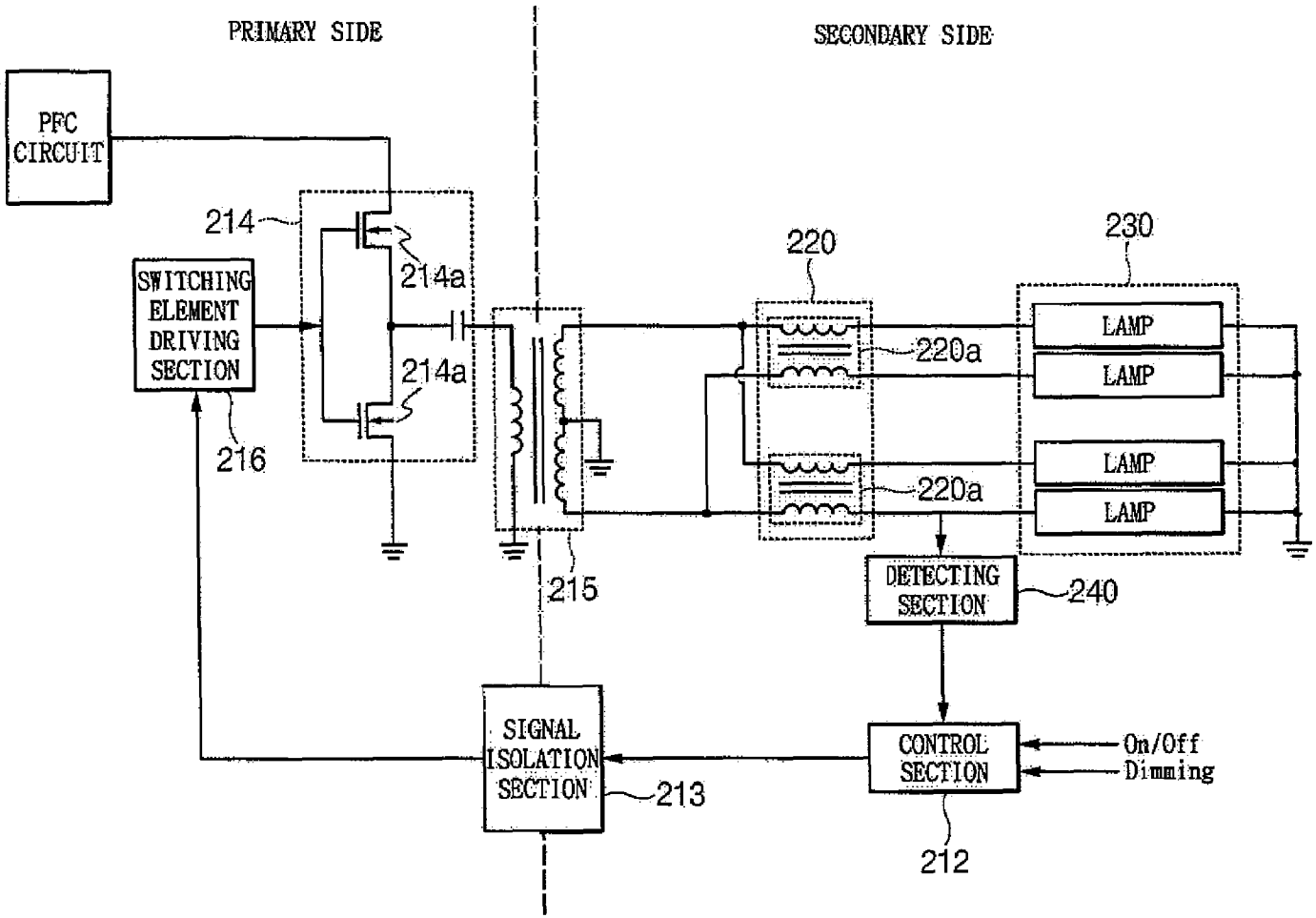

[FIG. 3]
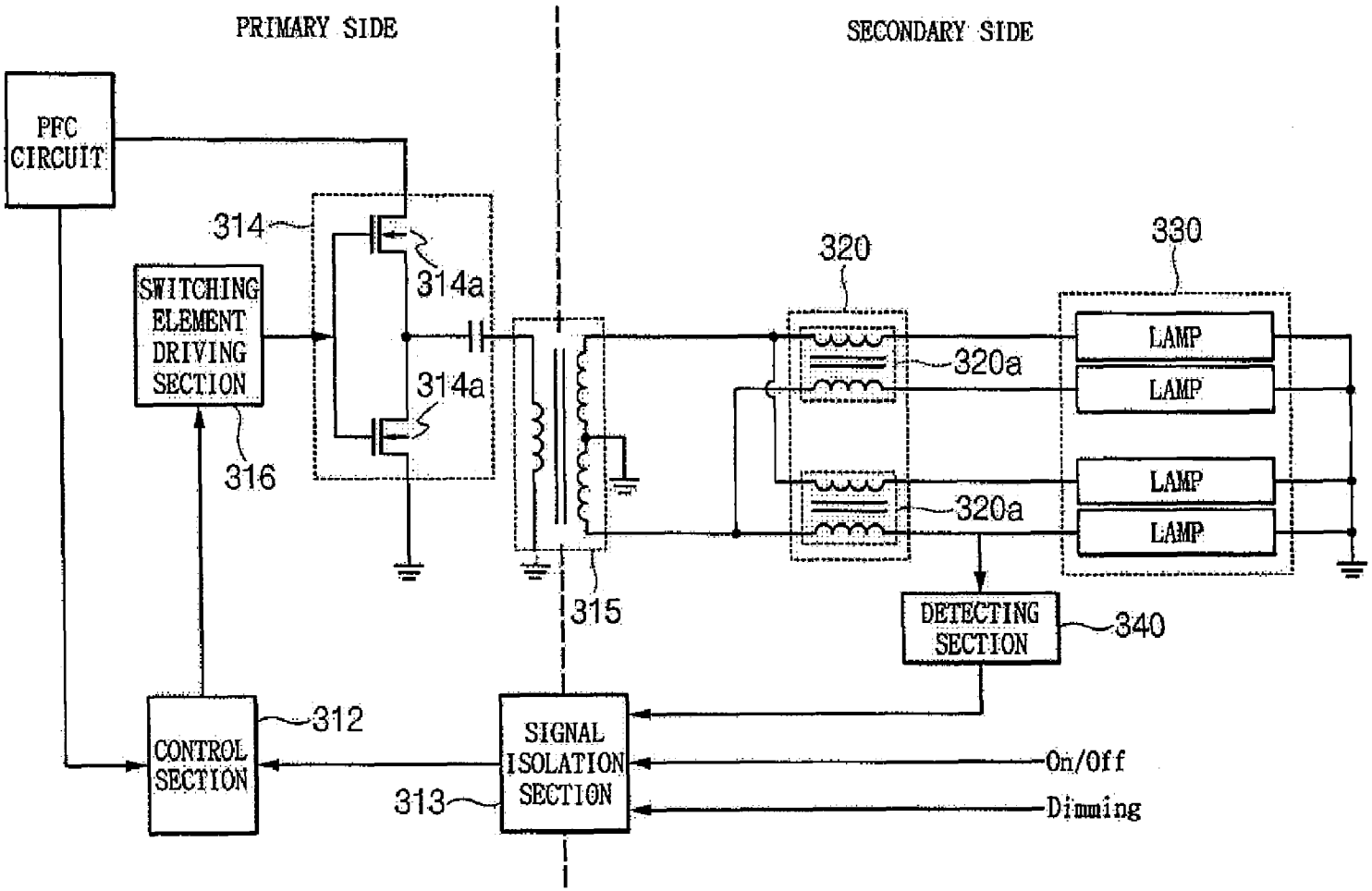

BACKLIGHT ASSEMBLY HAVING VOLTAGE BOOSTING SECTION WITH ELECTRICALLY ISOLATED PRIMARY SIDE AND SECONDARY SIDE

CROSS-REFERENCE TO RELATED APPLICATIONS

The application claims the benefit of Korea Patent Application No. 2005-112708 filed with the Korea Intellectual Property Office on Nov. 24, 2005 and Korea Patent Application No. 10-2006-0065722 filed with the Korea Intellectual Property Office on Jul. 13, 2006, the entire disclosures of which are incorporated herein by reference.

TECHNICAL FIELD

The disclosed embodiments of present invention relate to a backlight assembly.

BACKGROUND

In general, flat panel displays are roughly classified into light emission type displays and light reception type displays. Light emission type displays include flat cathode-ray tubes, plasma display panels, electroluminescence elements, fluorescent display devices, light emission diodes and the like. Light reception type displays include liquid crystal displays (LCD) and the like.

An LCD receives light from the outside to form an image, which is a characteristic of the light reception type displays. Therefore, on the rear of an LCD, a backlight assembly is installed so as to irradiate light.

In a general backlight assembly, high luminance, high efficiency, uniformity of luminance, long life span, slimness, low weight, low cost are required. In the case of a notebook computer, a highly-efficient lamp with a long life span is required so as to reduce power consumption. In the case of a monitor or TV, a lamp with high luminance is required.

FIG. 1 is a diagram schematically illustrating the construction of a conventional backlight assembly 100. As shown in FIG. 1, the backlight assembly includes a power supply section 110 composed of a rectifying section 111, a power factor correction (PFC) circuit 112, and a DC/DC converter 113; an inverter 120 composed of a plurality of transformers 122 and a controller 121 controlling the transformers 122; and a lamp unit 130 composed of a plurality of lamps connected to the transformers 122, respectively. As shown in FIG. 1, the backlight assembly 100 has such a structure that the power supply section 110 and the inverter 120 are separated from each other.

The rectifying section 111 converts alternating current (AC) input power into direct current (DC) input power. The PFC circuit 112 adjusts a power factor so as to convert the direct current input power, converted by the rectifying section 111, into direct current power having a predetermined magnitude (typically, 380 V), in order to enhance power efficiency of the backlight assembly. The DC/DC converter 113 converts the direct current power, converted by the PFC circuit 112, into direct current power having a predetermined magnitude (for example, 24 V) and simultaneously performs isolation between the power supply and the load.

Therefore, the DC/DC converter 113 outputs the isolated direct current power having a predetermined magnitude to the inverter 120.

A main function of the inverter 120 is to perform control such that a constant current is supplied to the respective lamps when and after the lamps are discharged, thereby minimizing a current deviation between the lamps.

Accordingly, in the conventional inverter 120, the plurality of transformers 122 are respectively connected to the lamps 130 and a secondary output current of each transformer 122 is constantly maintained, in order to implement the above-described function.

In the conventional backlight assembly, however, the power supply section 110 and the inverter 120 are separated from each other, so that there are difficulties in circuit design and production. Accordingly, productivity decreases, and power consumption increases.

Further, as one transformer is connected to only one lamp, the overall bulk of the circuit increases, and the efficiency of the power supply used for driving the conventional backlight assembly decreases. Further, as the lamps are directly connected to the transformers without a balancing circuit section, a luminous characteristic of the conventional backlight assembly decreases.

SUMMARY

According to an aspect, a backlight assembly comprises a switching section for switching on/off an input voltage so as to output a primary voltage in accordance with a control signal; a voltage boosting section for boosting the primary voltage received at a primary side thereof to a secondary voltage at a secondary side thereof, wherein the primary and secondary sides of said voltage boosting section are electrically isolated from each other; a feedback link for supplying the control signal from the secondary side to the primary side; and a signal isolation section in said feedback link for both transmitting the control signal from a secondary side portion of said feedback link to the switching section coupled to a primary side portion of said feedback link, and electrically isolating the primary side and secondary side portions of said feedback link.

According to another aspect, a backlight assembly, comprises a switching section for switching on/off a direct current voltage so as to output a primary voltage in accordance with a control signal; a voltage boosting section for boosting the primary voltage received at a primary side thereof to a secondary voltage at a secondary side thereof, wherein the primary and secondary sides of said voltage boosting section are electrically isolated from each other; a plurality of lamps connected in parallel to each other; a balancing circuit section that is connected to the secondary side of the voltage boosting section and said lamps so as to uniformly supply an alternating current, generated by the secondary voltage, to said lamps, in order to uniformize the luminances of the lamps; a detecting section positioned in the secondary side of the voltage boosting section, for detecting at least one of voltages and currents of the lamps so as to output a feedback signal for uniformly maintaining the luminance of light across the lamps; a control section for receiving the feedback signal from the detecting section so as to output the control signal for controlling the switching section; and a signal isolation section for both transmitting one of said feedback signal and control signal from the secondary side of the voltage boosting section to the control section in the primary side, and electrically isolating the detecting section in the secondary side from the switching section in the primary side.

According to a further aspect, a backlight assembly comprises a switching section for switching on/off an input voltage so as to output a primary voltage in accordance with a control signal; a voltage boosting section for boosting the primary voltage received at a primary side thereof to a secondary voltage at a secondary side thereof, wherein the primary and secondary sides of said voltage boosting section are electrically isolated from each other; a plurality of lamps connected in parallel to each other; and a balancing circuit section that is connected between the secondary side of the voltage boosting section and said lamps so as to uniformly supply an alternating current, generated by the secondary voltage, to said lamps, in order to uniformize the luminances of the lamps.

Objects and advantages of the disclosed embodiments of the present invention will become readily apparent to those skilled in the art from the following detailed description, wherein the embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

For a fuller understanding of the nature and objects of the disclosed embodiments of the invention, reference should be made to the following detailed description taken in connection with the accompanying drawings in which similar reference characters refer to similar parts:

FIG. 1 is a diagram illustrating a conventional backlight assembly;

FIG. 2 is a circuit diagram illustrating a backlight assembly according to a first embodiment of the present invention; and FIG. 3 is a circuit diagram illustrating a backlight assembly according to a second embodiment of the invention.

DETAILED DESCRIPTION OF EMBODIMENTS

In the following detailed description, for purposes of explanation, numerous specific details are set forth in order to provide a thorough understanding of the embodiments. It will be apparent, however, that the embodiments may be practiced without these specific details. In other instances, well-known structures and devices are schematically shown in order to simplify the drawing

First Embodiment

FIG. 2 is a circuit diagram illustrating a backlight assembly according to a first embodiment of the invention.

As shown in FIG. 2, the backlight assembly of the first embodiment includes a switching section 214, a voltage boosting section 215, a balancing circuit section 220, a detecting section 240, a control section 212, and a signal isolation section 213. In this embodiment, a power supply section and an inverter are constructed on one board, and hence, direct current power from a PFC circuit of the power supply section is directly applied to the voltage boosting section 215 of the inverter through the switching section 214.

Such a construction facilitates circuit design and production and allows power consumption to be reduced.

As disclosed in FIG. 1, a main function of the inverter is to perform control such that a constant current is supplied to the respective lamps when and after the lamps are discharged, thereby minimizing a current deviation between the lamps.

Since the lamps have high impedance before being lit up, a high discharge voltage is needed for lighting. After the lamps are discharged, the impedances thereof become much smaller than before they are discharged. Further, the impedances of the lamps differ from each other, because of the discharge of the lamps, currents induced in the lamps, a current deviation between the lamps and the like.

Therefore, a current of the lamp with low impedance continuously increases, and the impedance of the low impedance lamp with the increasing current continuously decreases, so that more and more current flows through the low impedance lamp. Accordingly, if an amount of current applied to each lamp is not controlled, only the luminance of the lamp of which the impedance has decreased continuously increases. As a result, the luminances of the other lamps continuously decrease. Further, a problem in lighting of the lamps can occur.

If such a situation continues, the lifespan of the low impedance lamp can be reduced or the lamp can be burnt, because of the negative impedance characteristic in which the voltage of such a low impedance lamp decreases and the current thereof continuously increases.

In order to prevent such a situation, the balancing circuit section 220 composed of a plurality of balancing coils 220*a* is connected to a secondary side of the voltage boosting section 215. Then, an alternating current generated by the voltage of the secondary side can be uniformly supplied to a plurality of lamps 230, which are fluorescent lamps in accordance with an arrangement of this embodiment. Accordingly, the luminance of light generated by the plurality of fluorescent lamps 230 can be uniformized to thereby enhance a luminous characteristic of the backlight assembly. It should be noted that balancing coils 220*a* are different from regular coils. In particular, each regular coil with inductance has a single output characteristic, whereas a balancing coil 220*a* in accordance with an arrangement of the present invention includes another coil which can adjust current balance. Therefore, the balancing coils 220*a* in accordance with such arrangement of the present invention basically have a characteristic and structure of transformers. It should be further noted that balancing circuit section 220 does not necessarily include balancing coils 220*a* which are not simple impedance components. Rather, balancing circuit section 220 should be understood as comprising components configured for maintaining balance when current unbalance occurs. For example, the balancing circuit section 220 can be implemented in other forms according to the circuit type or method of maintaining balance, such as Jin, Zaulus and the like. It is also within the scope of the present invention to provide a balancing circuit section 220 using capacitor(s), resistor(s), and active component(s). No matter how the balancing circuit section 220 is configured, its basic function remains to improve current unbalance occurring due to a current deviation between lamps 230.

The switching section 214, including a plurality of switching elements 214*a*, responds to a control signal output from the control section 212 so as to turn on and off direct-current power input from the PFC circuit, and switches the direct-current power through the on/off control so as to convert it into a voltage with a constant frequency. In accordance with another arrangement of the embodiment, such voltage is a square-wave voltage.

As the switching element 214*a*, a bipolar junction transistor (BJT), a field effect transistor (FET) and the like can be used.

Hereinafter, the description will be focused on the FET serving as the switching element 214*a*. However, the inventive concept of the invention can be applied to other elements which can be used as the switching element 214*a*. Although the following description will be focused on the FET, the concept and scope of the invention are not limited thereto.

The voltage boosting section 215 including at least a transformer receives the square-wave voltage converted by the switching section 214 through the primary side thereof so as to boost the square-wave voltage to a secondary-side voltage. Further, the voltage boosting section 215 converts the boosted secondary-side voltage into a sine-wave voltage through a resonance circuit (not shown), and supplies the converted secondary-side sine-wave voltage to the plurality of fluorescent lamps 230.

Since the power supply section 110 and the inverter 120 are separated from each other in the conventional backlight assembly, the DC/DC converter 113 of the power supply section 110 performs an isolation function to isolate the power supply from the load. In the invention according to an arrangement of the first embodiment, however, the power supply section and the inverter are constructed on one board. Therefore, the voltage boosting section 215 performs an isolation function to isolate the primary side from the secondary side. It is within the scope of the present invention to construct the power supply section and the inverter on different boards, provided that the voltage boosting section 215 performs the above-described isolation function.

The voltage boosting section 215 supplies a sine-wave secondary-side voltage in which the gap between the maximum level and the minimum level is identical between both ends of each lamp 230, and supplies a sine-wave secondary-side voltage in which positive and negative levels are identical between both ends of the plurality of fluorescent lamps 230. Further, the voltage boosting section 215 supplies an alternating current generated by the boosted secondary-side voltage to one end of each of the plurality of fluorescent lamps 230 through the balancing circuit section 220. The other ends of the fluorescent lamps 230 are grounded.

The transformer performs a function of boosting a PWM-shaped square-wave voltage converted by the switching section 214 into a secondary-side voltage. One or two transformers may be used. In the present embodiment, however, one transformer is used. In this particular arrangement, PWM (pulse-width modulation) is used for controlling output of the inverter, and hence the brightness of lamps 230. However, other methods of brightness controlling are not excluded.

In the present embodiment, the plurality of lamps 230 connected in parallel to each other can be driven by one transformer. Therefore, it is possible to reduce the overall bulk of the circuit and to enhance the efficiency of the power supply used for driving the backlight assembly.

The reason why the plurality of lamps 230 connected in parallel to each other can be driven by one transformer is that the balancing circuit section 220 is used to constantly control a current flowing in each lamp.

The detecting section 240 positioned in the secondary side of the voltage boosting section 215 detects voltages or currents of the plurality of fluorescent lamps 230 so as to output feedback signals for uniformly maintaining the luminance of light. Further, the detecting section 240 detects an abnormal state of at least one of the plurality of fluorescent lamps 230 so as to output a circuit breaking signal for breaking the circuit. In an arrangement of this embodiment, the detecting section 240 includes one or more current and/or voltage detectors. Other arrangements of the detecting section 240, however, are not excluded.

The detecting section 240 can be connected to a secondary output stage of the voltage boosting section 215 and/or an output stage of the balancing circuit section 220. In other words, the following arrangements are within the scope of the present invention: case 1) the balancing circuit section 220 and the detecting section 240 are connected to each other such that detection is carried out only in the balancing circuit section 220, case 2) the voltage boosting section 215 and the detecting section 240 are connected to each other such that detection is carried out only in the voltage boosting section 215, and case 3) the voltage boosting section 215 and the balancing circuit section 220 are respectively connected to the detecting section 240 such that detection is carried out in both the voltage boosting section 215 and the balancing circuit section 220.

The control section 212, positioned in the secondary side of the transformer of the voltage boosting section 215, receives a feedback signal and/or circuit breaking signal from the detecting section 240 so as to output a control signal for controlling the switching section 214.

The control section 212 can also receive an on/off signal and/or a dimming signal from the outside, the dimming signal controlling the brightness of the lamps 230.

The control section 212 can output the control signal as an analog signal, and may include a digital/analog converter (not shown) which converts a PWM-shaped dimming signal among the signals supplied from the outside into an analog signal. Other arrangements in which the control section 212 outputs the control signal as a digital signal or as a combination of digital and analog signals are not excluded.

As described above, the DC/DC converter, which is intended to isolate the power supply from the load in the conventional backlight assembly, is removed. Therefore, grounding portions of the primary and secondary sides of the voltage boosting section 215 need to be separated from each other.

The reason is as follows. A primary-side portion of an electric product used in a home forms one loop, and a second-side portion thereof is operated by people and is individually formed for each product. Therefore, if grounding portions of the primary and secondary sides are not separated from each other, problems (such as EMI, PF, surge and the like) occurring in one product can be induced to another electric product adjacent thereto, and safety problems such as an electric shock and the like can occur because of a secondary-side power supply operated by people.

In order to prevent such problems, the backlight assembly according to the first embodiment includes the signal isolation section 213 which not only outputs a control signal output from the control section 212 to the switching section 214, but also isolates the control section 212 positioned in the secondary side from the switching section 214 positioned in the primary side.

The signal isolation section 213 can be composed of a photo coupler or a transformer.

In order to improve driving performance of the plurality of FETs 214*a* included in the switching section 214, the backlight assembly according to the first embodiment may include a switching element driving section 216 which amplifies a control signal output from the signal isolation section 213 and outputs the amplified control signal to the plurality of FETs 214*a* of the switching section 214.

Second Embodiment

FIG. 3 is a circuit diagram of a backlight assembly according to a second embodiment of the invention.

As shown in FIG. 3, the backlight assembly includes a switching section 314, a voltage boosting section 315, a balancing circuit section 320, a detecting section 340, a control section 312, and a signal isolation section 313. In this embodiment, a power supply section and an inverter are constructed on one board, and hence, direct current power from a PFC circuit of the power supply section is directly applied to the voltage boosting section 315 of the inverter through the switching section 314.

Such a construction facilitates circuit design and production and allows power consumption to be reduced.

Similar to the first embodiment, the balancing circuit section 320 composed of a plurality of balancing coils 320*a* is connected to the secondary side of the voltage boosting section 315, in order to control the lamp's currents which are dependent on the lamp's characteristics. Then, an alternating current generated by the voltage of the secondary side can be uniformly supplied to the plurality of fluorescent lamps 330. Accordingly, the luminance of light generated by the plurality of fluorescent lamps 330 can be uniformized to thereby enhance a luminous characteristic of a backlight assembly.

The switching section 314, including a plurality of switching elements 314*a*, responds to a control signal output from the control section 312 so as to turn on and off direct-current power input from the PFC circuit, and switches the direct-current power through the on/off control so as to convert it into a voltage with a constant frequency. In accordance with an arrangement of the embodiment, such voltage is a square-wave voltage As the switching element 314*a*, a bipolar junction transistor (BJT), a field effect transistor (FET) and the like can be used.

Hereinafter, the description will be focused on the FET serving as the switching element 314*a*. However, the inventive concept of the invention can be applied to other elements which can be used as the switching element 314*a*. Although the following description is focused on the FET, the concept and scope of the invention are not limited thereto.

The voltage boosting section 315 including at least a transformer receives the square-wave voltage converted by the switching section 314 through the primary side thereof so as to boost the square-wave voltage to a secondary-side voltage. Further, the voltage boosting section 215 converts the boosted secondary-side voltage into a sine-wave voltage through a resonance circuit (not shown), and supplies the converted sine-wave secondary-side voltage to the plurality of fluorescent lamps 330.

Since the power supply section 110 and the inverter 120 are separated from each other in the conventional backlight assembly, the DC/DC converter 113 of the power supply section 110 performs an isolation function to isolate the power supply from the load. In the invention according to an arrangement of the second embodiment, however, the power supply section and the inverter are constructed on one board. Therefore, the voltage boosting section 315 performs an isolation function to isolate the primary side from the secondary side. It is within the scope of the present invention to construct the power supply section and the inverter on different boards, provided that the voltage boosting section 315 performs the above-described isolation function.

The voltage boosting section 315 supplies a sine-wave secondary-side voltage in which the gap between the maximum level and the minimum level is identical between both ends of the plurality of fluorescent lamps 330 and positive and negative levels are identical to each other. Further, the voltage boosting section 315 supplies an alternating current generated by the boosted secondary-side voltage to one end of each of the plurality of fluorescent lamps 330 through the balancing circuit section 320. The other ends of the fluorescent lamps 230 are grounded.

The transformer performs a function of boosting a PWM-shaped square-wave voltage converted by the switching section 314 into a secondary-side voltage. One or two transformers may be used. In the present embodiment, however, one transformer is used.

In the present embodiment, the plurality of lamps 330 connected in parallel to each other can be driven by one transformer. Therefore, it is possible to reduce the overall bulk of the circuit and to enhance the efficiency of the power supply used for driving the backlight assembly.

The reason why the plurality of lamps 330 connected in parallel to each other can be driven by one transformer is that the balancing circuit section 320 is used to constantly control a current flowing in each lamp.

The detecting section 340 positioned in the secondary side of the voltage boosting section 315 detects voltages or currents of the plurality of fluorescent lamps 330 so as to output feedback signals for uniformly maintaining the luminance of light. Further, the detecting section 340 detects an abnormal state of at least one of the plurality of fluorescent lamps 330 so as to output a circuit breaking signal for breaking the circuit. In an arrangement of this embodiment, the detecting section 340 includes one or more current and/or voltage detectors. Other arrangements of the detecting section 340, however, are not excluded.

The detecting section 340 can be connected to a secondary output stage of the voltage boosting section 315 or an output stage of the balancing circuit section 320.

The control section 312, unlike the control section 212 of the first embodiment, is positioned in the primary side of the transformer of the voltage boosting section 315, and receives a feedback signal and/or circuit breaking signal from the detecting section 340 so as to output a control signal for controlling the switching section 314.

As described above, the DC/DC converter, which is intended to isolate the power supply from the load in the conventional backlight assembly, is removed. Therefore, grounding portions of the primary and secondary sides of the voltage boosting section 315 need to be separated from each other, similar to the first embodiment.

The reason is as follows. A primary-side portion of an electric product used in a home forms one loop, and a second-side portion thereof is operated by people and is individually formed for each product. Therefore, if grounding portions of the primary and secondary sides are not separated from each other, problems (such as EMI, PF, surge and the like) occurring in one product can be induced in another electric product adjacent thereto, and safety problems such as an electric shock and the like can occur because of the secondary-side power supply operated by people.

In order to prevent such problems, the backlight assembly according to the second embodiment includes the signal isolation section 313 which outputs a feedback signal and/or circuit breaking signal output from the detecting section 340 to the control section 312 and simultaneously isolates the detecting section 340 positioned in the secondary side from the control section 312 positioned in the primary side.

The signal isolation section 313 may be composed of a photo coupler or transformer. The signal isolation section 313 can also output an on/off signal and/or a dimming signal, which are supplied from the outside for controlling the brightness of a lamp, to the control section 312 in the primary side. The on/off signal and/or dimming signal can, in accordance with an alternative arrangement of the embodiment, be directly fed to the control section 312.

Since the control section 312 can output the control signal as an analog signal, and may include a digital/analog converter (not shown) which converts a PWM-shaped dimming signal among the signals output from the signal isolation section 313 into an analog signal. Other arrangements in which the control section 212 outputs the control signal as a digital signal or as a combination of digital and analog signals are not excluded.

In order to improve driving performance of the plurality of FETs 314*a* included in the switching section 314, the backlight assembly according to the second embodiment may include a switching element driving section 316 which amplifies a control signal output from the control section 312 and outputs the amplified control signal to the plurality of FETs 314*a* of the switching section 314.

According to the backlight assembly of an arrangement of the disclosed embodiments of the invention, the power supply section and the inverter are constructed on one board. Therefore, circuit design and production can be facilitated, and power consumption can be reduced.

Further, as the balancing circuit is used in the backlight assembly of a further arrangement of the disclosed embodiments of the invention, it is possible to enhance a luminous characteristic of the backlight assembly.

In addition, since the plurality of lamps connected in parallel to each other can be driven by one transformer in the backlight assembly of a further arrangement of the disclosed embodiments of the invention, it is possible to reduce the overall bulk of the circuit and to enhance the efficiency of the power supply used for driving the backlight assembly.

Furthermore, if the power supply section and the inverter are constructed on one board, there is a requirement for isolation between the power supply and the load. However, such a requirement can be satisfied by a simple component such as a signal isolation section, which, in accordance with a further arrangement of the disclosed embodiments of the invention, can be a photo coupler or transformer.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A backlight assembly, comprising:

a switching section for switching on/off an input voltage so as to output a primary voltage in accordance with a control signal;

a voltage boosting section for boosting the primary voltage received at a primary side thereof to a secondary voltage at a secondary side thereof, wherein the primary and secondary sides of said voltage boosting section are electrically isolated from each other;

a feedback link for supplying the control signal from the secondary side to the primary side; and a signal isolation section in said feedback link for both transmitting the control signal from a secondary side portion of said feedback link to the switching section coupled to a primary side portion of said feedback link, and electrically isolating the primary side and secondary side portions of said feedback link.

2. The backlight assembly according to claim 1, wherein the voltage boosting section includes one or two transformers.

3. The backlight assembly according to claim 1, wherein the signal isolation section comprises a photo coupler or transformer.

4. The backlight assembly according to claim 1, further comprising:

a switching element driving section for amplifying the control signal prior to outputting the amplified control signal to the switching section.

5. The unit backlight assembly according to claim 2, wherein the secondary voltage supplied by the voltage boosting section is a sine-wave secondary-side voltage in which the gap between the maximum level and the minimum level is identical between both ends of each lamp.

6. The backlight assembly according to claim 5, wherein the sine-wave secondary-side voltage has positive and negative levels which are identical between both ends of the plurality of lamps which, in turn, are fluorescent lamps.

7. The backlight assembly according to claim 6, wherein one end of each of the plurality of fluorescent lamps is coupled to the secondary side of the voltage boosting section for receiving an alternating current generated by the sine-wave secondary-side voltage, whereas the other ends of said lamps are grounded.

8. A backlight assembly, comprising:

a switching section for switching on/off a direct current voltage so as to output a primary voltage in accordance with a control signal;

a voltage boosting section for boosting the primary voltage received at a primary side thereof to a secondary voltage at a secondary side thereof, wherein the primary and secondary sides of said voltage boosting section are electrically isolated from each other;

a plurality of lamps connected in parallel to each other;

a balancing circuit section that is connected to the secondary side of the voltage boosting section and said lamps so as to uniformly supply an alternating current, generated by the secondary voltage, to said lamps, in order to uniformize the luminances of the lamps;

a detecting section positioned in the secondary side of the voltage boosting section, for detecting at least one of voltages and currents of the lamps so as to output a feedback signal for uniformly maintaining the luminance of light across the lamps;

a control section for receiving the feedback signal from the detecting section so as to output the control signal for controlling the switching section; and a signal isolation section for both transmitting one of said feedback signal and control signal from the secondary side of the voltage boosting section to the control section in the primary side, and electrically isolating the detecting section in the secondary side from the switching section in the primary side.

9. The backlight assembly according to claim 8, further comprising:

a switching element driving section for amplifying the control signal prior to outputting the amplified control signal to a plurality of switching elements of the switching section.

10. The backlight assembly according to claim 8, wherein the control section has inputs for receiving at least one of an on/off signal and a dimming signal from the outside; and the control section is positioned in the secondary side and is electrically connected between the detecting section and the signal isolation section.

11. The backlight assembly according to claim 10, wherein the control section further includes a digital/analog converter for converting the dimming signal, which is a PWM-shaped dimming signal, into an analog signal.

12. The backlight assembly according to claim 8, wherein the control section is positioned in the primary side and is electrically connected between the switching section and the signal isolation section; and the signal isolation section has inputs for receiving and transmitting at least one of an on/off signal and a dimming signal, supplied from the outside, to the control section in the primary side.

13. The backlight assembly according to claim 12, wherein the control section further includes a digital/analog converter for converting the dimming signal, which is a PWM-shaped dimming signal, into an analog signal.

14. The backlight assembly according to claim 9, wherein the plurality of switching elements are FETs.

15. The backlight assembly according to claim 8, wherein the signal isolation section comprises a photo coupler or transformer.

16. The backlight assembly according to claim 8, wherein one end of each of the plurality of lamps, which are fluorescent lamps, is coupled, through the balancing circuit section, to the secondary side of the voltage boosting section for receiving an alternating current generated by the secondary voltage, whereas the other ends of said lamps are grounded.

17. The backlight assembly according to claim 8, wherein the detecting section is connected to the secondary output stage of the voltage boosting section.

18. The backlight assembly according to claim 8, wherein the detecting section is connected to the output stage of the balancing circuit section.

19. A backlight assembly, comprising:

a switching section for switching on/off an input voltage so as to output a primary voltage in accordance with a control signal;

a voltage boosting section for boosting the primary voltage received at a primary side thereof to a secondary voltage at a secondary side thereof, wherein the primary and secondary sides of said voltage boosting section are electrically isolated from each other;

a plurality of lamps connected in parallel to each other; and a balancing circuit section that is connected between the secondary side of the voltage boosting section and said lamps so as to uniformly supply an alternating current, generated by the secondary voltage, to said lamps, in order to uniformize the luminances of the lamps.

20. The backlight assembly according to claim 19, wherein said balancing circuit section comprises a plurality of coils each connected in series with one of said lamps.

21. The backlight assembly according to claim 20, wherein the coils connected to adjacent lamps are connected to different terminals of the secondary side of the voltage boosting section.

22. The backlight assembly according to claim 20, wherein the coils connected to adjacent lamps are magnetically coupled with one another, but are not electrically connected to a common terminal of the secondary side of the voltage boosting section.

23. The backlight assembly according to claim 20, wherein secondary side of the voltage boosting section has two opposite terminals and a middle point being grounded; and the coils connected to adjacent lamps are magnetically coupled with one another, and are electrically connected to the opposite terminals of the secondary side of the voltage boosting section, respectively.

* * * * *